US010479580B1

(12) United States Patent
McCumber

(10) Patent No.: US 10,479,580 B1
(45) Date of Patent: Nov. 19, 2019

(54) PROCESS FOR SEPARATING PACKAGE BLISTER FROM CARDS FOR RECYCLING

(71) Applicant: Placon Corporation, Madison, WI (US)

(72) Inventor: Donald E. McCumber, Madison, WI (US)

(73) Assignee: Placon Corporation, Madison, WI (US)

( * ) Notice: Subject to any disclaimer, the term of this patent is extended or adjusted under 35 U.S.C. 154(b) by 0 days.

(21) Appl. No.: 16/427,592

(22) Filed: May 31, 2019

Related U.S. Application Data

(63) Continuation of application No. 15/619,003, filed on Jun. 9, 2017.

(60) Provisional application No. 62/361,854, filed on Jul. 13, 2016.

(51) Int. Cl.

| | |
|---|---|
| ***B65D 73/00*** | (2006.01) |
| ***B65D 75/58*** | (2006.01) |
| ***B65D 75/42*** | (2006.01) |
| ***B65D 75/56*** | (2006.01) |

(52) U.S. Cl.
CPC ..... *B65D 75/5888* (2013.01); *B65D 73/0057* (2013.01); *B65D 73/0092* (2013.01); *B65D 75/42* (2013.01); *B65D 75/566* (2013.01); *B65D 75/5827* (2013.01)

(58) Field of Classification Search
CPC ..... B65D 73/0057; B65D 73/0092; B65D 75/22; B65D 75/322; B65D 75/323; B65D 75/324; B65D 75/325; B65D 75/326; B65D 75/327; B65D 75/368; B65D 75/367; B65D 75/366
USPC ..... 206/471, 462, 461
See application file for complete search history.

(56) References Cited

U.S. PATENT DOCUMENTS

| | | | | |
|---|---|---|---|---|
| 3,246,747 | A | 4/1966 | Blish | |
| 3,399,763 | A * | 9/1968 | Stone | B65D 73/0057 206/462 |
| 3,948,393 | A | 4/1976 | Lewi | |
| 4,191,293 | A | 3/1980 | Newman | |
| 4,210,246 | A | 7/1980 | Kuchenbecker | |
| 4,266,666 | A | 5/1981 | Kuchenbecker | |
| 4,485,920 | A | 12/1984 | Skylvik | |
| 4,569,442 | A * | 2/1986 | Bushey | B65D 43/162 206/469 |
| 4,779,734 | A | 10/1988 | Kydonicus | |
| 4,781,289 | A | 11/1988 | Perkins | |
| 5,379,895 | A | 1/1995 | Foslien | |
| 5,657,874 | A | 8/1997 | Hustad et al. | |

(Continued)

*Primary Examiner* — Robert Poon
(74) *Attorney, Agent, or Firm* — Stiennon & Stiennon

(57) ABSTRACT

A method for separating a package blister from the cards which retain it to promote recycling of the component parts of a package. A thermoformed thermoplastic blister has a product bubble which extends from a peripheral flange to extend through an opening in a front card. The front card is affixed to a back card so as not to adhere to the blister flange. The blister has a pull feature which is accessible for gripping by a user to engage and remove the blister from the front card and the back card. To separate the blister from the cards a user grips the pull feature and pulls the blister frontwardly, thereby distorting the blister and extracting the blister from the cards, to fully separate the blister from the front card and the back card, permitting the entire package to be recycled.

3 Claims, 1 Drawing Sheet

(56) References Cited

U.S. PATENT DOCUMENTS 5,934,475 A * 8/1999 Hikake ..... B41J 2/17533 206/461
6,053,321 A 4/2000 Kayser
6,131,737 A 10/2000 Marshall
6,308,832 B1 10/2001 Pirro et al.
6,439,390 B1 8/2002 Kumakura et al.
6,619,480 B2 9/2003 Smith
6,648,140 B2 * 11/2003 Petricca ..... A45D 27/225 206/356
7,621,400 B2 11/2009 Smith et al.
7,726,480 B2 6/2010 Nazari
8,042,689 B2 10/2011 Fröjd et al.
8,091,704 B2 1/2012 Trigg
8,146,745 B2 4/2012 Burress et al.
8,151,988 B2 4/2012 Smith et al.
8,151,989 B2 4/2012 Appelabaum et al.
8,205,746 B2 6/2012 Nazari
8,225,933 B2 7/2012 Wade
8,251,214 B2 8/2012 Wade
8,376,139 B2 2/2013 Arnold
8,453,840 B2 * 6/2013 Wharton ..... B65D 5/38 206/1.5
8,550,250 B2 10/2013 Wade
8,708,146 B2 4/2014 Falcon
9,422,101 B2 * 8/2016 Wu ..... B65D 73/0092
2007/0125666 A1 6/2007 Nazari
2008/0217199 A1 9/2008 Burress et al.
2009/0159479 A1 6/2009 Smith et al.
2009/0223840 A1 9/2009 Nazari
2010/0206755 A1 8/2010 Wade
2011/0017627 A1 1/2011 Wade et al.
2011/0290675 A1 12/2011 Shiue et al.
2013/0228488 A1 9/2013 Wu et al.
2013/0319896 A1 12/2013 Corbat et al.
2013/0341230 A1 12/2013 Brandel et al.
2014/0209497 A1 7/2014 Jacobus
2014/0353198 A1 12/2014 Bradfield
2015/0021224 A1 1/2015 Vossoughi et al.
2015/0329258 A1 11/2015 Brandow
2016/0083160 A1 3/2016 Bley
2016/0101919 A1 4/2016 Zacherle et al.
2016/0113377 A1 4/2016 Moussion et al.

* cited by examiner

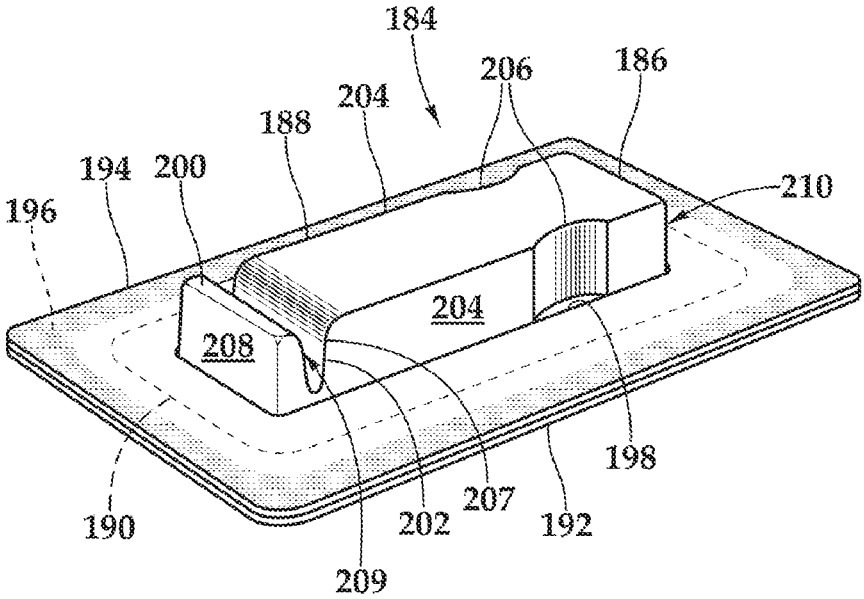
184
206
186
204
188
194
200
210
196
204
208
198
207
202
192
190
209

PROCESS FOR SEPARATING PACKAGE BLISTER FROM CARDS FOR RECYCLING

CROSS REFERENCES TO RELATED APPLICATIONS

This application is a continuation of U.S. application Ser. No. 15/619,003, filed Jun. 9, 2017, which claims priority on U.S. provisional App. No. 62/361,854 filed on Jul. 13, 2016, the disclosures of both which applications are incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to packages generally, and more particularly to packages assembled from plastic and non-plastic components.

Product packages can advantageously be manufactured from various materials.

Molded transparent blisters can retain and position products for examination by the purchaser, while printed paper or cardstock elements can display images which attract the shopper's attention, distinguish and brand the product, and provide helpful or required information about the product's composition or use. Both these components can be fabricated at low cost, and are often disposed of after the product has been extracted or consumed.

The prudent customer can limit the waste stream to landfills by recycling a package which has served its use. In many municipalities recycling streams are maintained for both plastic and paper fiber materials. Yet materials are more effectively recovered when these two types of materials are not mixed. Hence a package which can be readily separated into distinct paper fiber and plastic components is a desirable enhancement to recycling material flows. There are many packaging structures that make this possible. For example, plastic clamshell containers which contain paperboard internal cards or which are ultrasonically sealed to external cards. Yet more options for package configuration and filling would be offered by a package employing adhesively adhered card elements with thermoformed thermoplastic blisters which are in no way adhered to the cards.

SUMMARY OF THE INVENTION

The plastic and paper fiber elements of a disposable package are readily separated for recycling by affixing a front card to a rear card with adhesive so as to trap the flange of a thermoformed blister between the two cards without adhering the blister to either card. The flange is generously dimensioned to accommodate the less precise positioning of the blister needed to keep it clear of contact with the card adhesive. Because of the deformable nature of a thermoformed thin-sheet part, the blister can be distorted to extract it out through an opening in the card through which the blister product bubble protrudes.

The package has a blister with a frontwardly protruding pull feature, separated by a deep groove from a product bubble, which a user may grip to pull the blister frontwardly to distort the blister to extract it from the cards to which it is mounted by an unglued flange. The product bubble may have frontwardly extending side walls formed with concave frontwardly extending recesses which provide points of engagement for a user's thumb and forefinger, such that the product bubble of the plastic blister may be squeezed to distort the side walls towards each other sufficiently that the user can securely engage and distort the blister to extract it from the cards.

It is an object of the present invention to provide a method by which a disposable package is readily broken down into plastic and nonplastic components for recycling.

Further objects, features and advantages of the invention will be apparent from the following detailed description when taken in conjunction with the accompanying drawing.

BRIEF DESCRIPTION OF THE DRAWINGS

The FIGURE is a top isometric view of a package.

DESCRIPTION OF THE PREFERRED EMBODIMENTS

A package 184 is shown in the FIGURE. The package 184 has a thermoformed thermoplastic blister 186 with a product bubble 188 which projects frontwardly a first height from a peripheral flange 190 which is trapped between a rear card 192 and a front card 194 which are glued together in a region of adhesive 196, shown in the FIGURE by a stipple pattern, that avoids the flange. The product bubble 188 has a first wall 207 which is spaced from a third wall 210 in a direction perpendicular to the frontward direction. Also extending from the flange 190 and alongside the product bubble 188 is a frontwardly protruding pull feature 200 which extends the first height in the frontward direction and which serves as an extraction tab which extends frontwardly. The pull feature has an end wall 208 which is spaced in a direction perpendicular to the frontward direction from a second wall 209. The pull feature 200 is defined by a deep groove 202 that extends substantially to the cards and that distinguishes it from the product bubble 188. The front card 194 has a bubble opening 198 through which the product bubble 188 and the pull feature 200 extend. The distance between the first wall 207 and the third wall 210 of the product bubble is substantially greater than the distance between the end wall 208 and the second wall 209 of the pull feature. The pull feature 200 is sufficiently deep in the frontward direction that a user can grip the pull feature and pull the blister 186 frontwardly, thereby distorting the blister to extract it from the cards or tear the front card 194 to allow the plastic blister to be fully separated from the cards 192, 194 and permit the entire package to be recycled.

The product bubble 188 has frontwardly extending side walls 204 which may optionally be formed with concave frontwardly extending recesses 206 on opposite side walls. The recesses 206 provide points of engagement for a user's thumb and forefinger, such that the product bubble 188 of the plastic blister 186 may be squeezed to distort the side walls 204 towards each other sufficiently that the user can securely engage and distort the blister to extract it from the cards 192, 194. Portions of the front card defining the bubble opening are rectangular so that portions of the peripheral flange 190 adjacent the pair of curved recesses 206 are not overlain by the front card 194.

I claim:

1. A method for separating components of a package for recycling, the package comprising:

a thermoformed thermoplastic blister having a product bubble and a pull feature, the blister having a peripheral flange which extends outwardly from the product bubble and the pull feature;

a front card having an exterior surface and an opposite interior surface, portions of the front card defining a bubble opening having a perimeter, wherein the product bubble extends through the bubble opening;

a back card having an interior surface which is adhered to the front card interior surface, and an opposite exterior surface, wherein the blister flange is retained between the front card and the back card so that the product bubble and the pull feature extend through the front card bubble opening, wherein the blister flange is not adhered to the front card or the back card;

wherein the product bubble extends through the front card bubble opening in a first direction which is perpendicular to the back card, and wherein the bubble extends in the first direction to a frontwardmost elevation which defines a first height above the front card exterior surface; and wherein the pull feature extends the first height in the first direction above the front card exterior surface and is separated from the product bubble by a groove formed in the blister which extends transverse to the first direction, the groove having a depth substantially that of the first height and a width so that the pull feature is accessible on two opposed sides; the method comprising the steps of:

gripping the pull feature;

pulling the blister frontwardly, thereby distorting the blister; and extracting the blister from the cards, and thereby fully separating the blister from the front card and the back card, permitting the entire package to be recycled.

2. A method for separating a blister package into a plastic part and a card part for recycling, the package comprising:

a thermoformed thermoplastic blister with a product bubble which projects frontwardly from a peripheral flange in a first direction, the product bubble having a first wall which extends in the first direction away from the flange;

a rear card;

a front card spaced in the first direction from the rear card and glued to the rear card, wherein the flange is trapped between the rear card and the front card, the rear card being glued to the front card by a region of adhesive that avoids the flange;

a frontwardly protruding pull feature which extends from the flange alongside the product bubble, wherein the pull feature has:

an end wall which extends frontwardly from the peripheral flange;

a second wall which extends frontwardly from the product bubble first wall to engage the end wall, the second wall diverging in a second direction which is perpendicular to the first direction as it extends frontwardly from the flange, to thereby define a deep groove between the pull feature and the product bubble, the deep groove extending substantially to the cards, and the end wall at its maximum spacing from the second wall in the second direction being spaced a first amount from the second wall;

wherein the product bubble has a third wall spaced a second amount from the first wall in the second direction away from the end wall, and the second amount being substantially greater than the first amount, and wherein the front card has a bubble opening through which the product bubble and the pull feature extend, the method comprising:

gripping the pull feature; and pulling the blister frontwardly, thereby distorting the blister to extract it from the cards or tear the front card to fully separate the plastic blister from the front card and the rear card and permit the entire package to be recycled.

3. A method for separating components of a package for recycling, the package comprising:

a thermoformed thermoplastic blister having a product bubble, the blister having a peripheral flange which extends outwardly from the product bubble and a pull feature, the product bubble having a frontwardmost front wall, wherein the blister product bubble has a first side wall and a second side wall which each extend from the peripheral flange to the front wall, and which are spaced on opposite sides of the blister product bubble;

portions of the first side wall which define a first recessed concavity extending from the peripheral flange to the front wall of the product bubble; and portions of the second side wall which define a second recessed concavity extending from the peripheral flange to the front wall of the product bubble, the first concavity recess being spaced from the second concavity recess to provide points of engagement for a user's thumb and forefinger;

a front card having an exterior surface and an opposite interior surface, portions of the front card defining a bubble opening having a perimeter, wherein the product bubble extends through the bubble opening;

a back card having an interior surface which is adhered to the front card interior surface, and an opposite exterior surface, wherein the blister flange is retained between the front card and the back card so that the product bubble extends through the front card bubble opening, wherein the blister flange is not adhered to the front card or the back card; the method comprising the steps of:

engaging the first concavity recess and the second concavity recess between the thumb and forefinger of a user's hand;

squeezing the product bubble to distort the side walls towards each other sufficiently to distort the blister; and extracting the blister from the front and back cards thereby fully separating the blister from the front card and the back card, permitting the entire package to be recycled.

* * * * *